United States Patent [19]

Bell

[11] Patent Number: 4,810,103

[45] Date of Patent: Mar. 7, 1989

[54] RESEALABLE BAG CLOSURE ARRANGEMENT

[76] Inventor: Donald G. Bell, 7896 La Mirada Cir., Buena Park, Calif. 90620

[21] Appl. No.: 176,060

[22] Filed: May 31, 1988

[51] Int. Cl.[4] ..... B65D 33/16

[52] U.S. Cl. ..... 383/70; 383/90; 383/905

[58] Field of Search ..... 383/70, 71, 88, 95, 383/905, 77, 89, 90

[56] References Cited

U.S. PATENT DOCUMENTS

| | | | |
|---|---|---|---|
| 331,357 | 12/1885 | Wineberger | 383/905 X |
| 892,330 | 6/1908 | Tavis | 383/905 X |
| 2,210,859 | 8/1940 | Schafer | 383/905 X |
| 2,444,891 | 7/1948 | Johnsson | 383/905 X |
| 3,189,253 | 6/1965 | Mojonnier | 383/905 X |
| 3,201,030 | 8/1965 | Pollack | 383/905 X |
| 3,311,288 | 3/1967 | Lemelson | 383/905 X |
| 3,321,126 | 5/1967 | Rivman et al. | 383/905 X |
| 3,556,390 | 1/1971 | Gould et al. | 150/3 |
| 3,578,236 | 5/1971 | Masayuki | 383/905 X |
| 3,754,371 | 8/1973 | Walker, III | 53/38 |
| 4,051,994 | 10/1977 | Donk et al. | 229/65 |
| 4,408,643 | 10/1983 | Laske et al. | 383/70 |

*Primary Examiner*—Stephen Marcus
*Assistant Examiner*—Nova Stucker
*Attorney, Agent, or Firm*—Henderson & Sturm

[57] ABSTRACT

A resealable bag closure apparatus (10) including a bag member (13) having a mouth portion (15) and a closure unit (12) including an elongated flexible wire (21) arranged in a serpentine configuration and operatively attached to the flexible walls (14) of the bag member (13) and disposed at a location proximate to, but spaced from the mouth portion (15) of the bag member (13) to form a resealable closure for the apparatus (10).

3 Claims, 1 Drawing Sheet

FIG. 1.
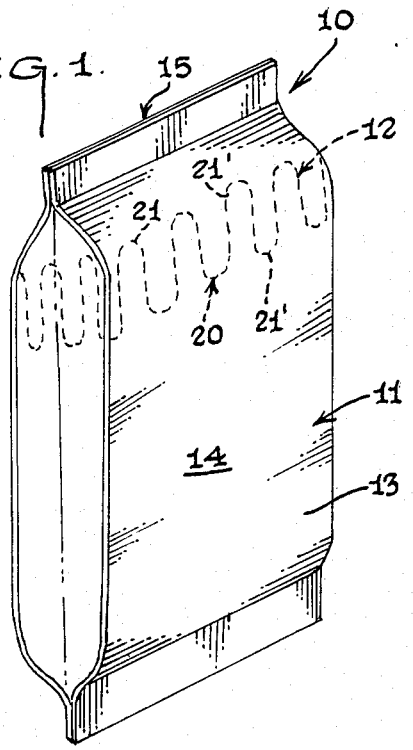
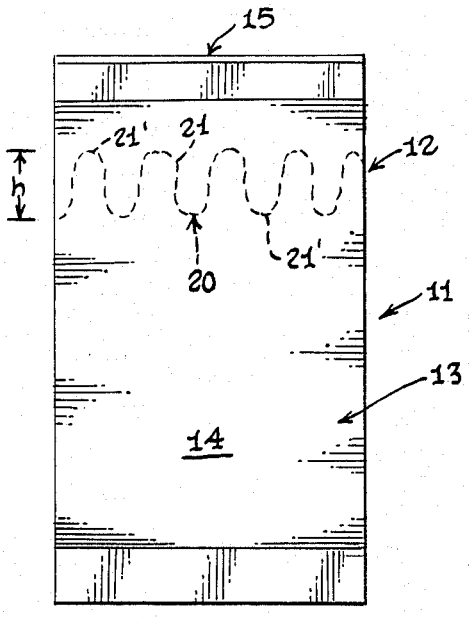
FIG. 2.
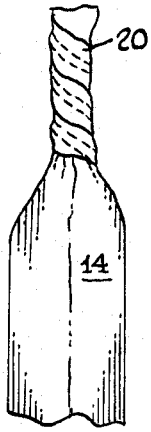
FIG. 3.
FIG. 4.
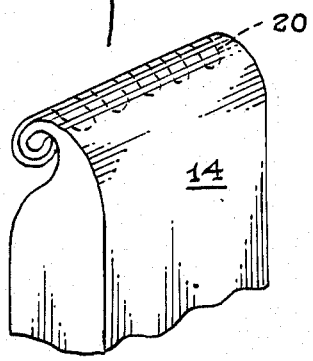
FIG. 5.
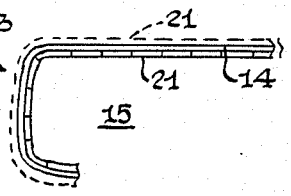
FIG. 6.
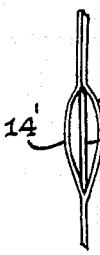

RESEALABLE BAG CLOSURE ARRANGEMENT

TECHNICAL FIELD

The present invention relates to the field of resealable closure arrangements for flexible food packaging.

BACKGROUND OF THE INVENTION

The present invention was the subject matter of Document Disclosure Program Registration No. 153549 which was filed in the United States Patent and Trademark Office on July 21, 1986.

As can be seen by reference to the following U.S. Pat. Nos: 3,556,390; 3,754,371; 4,408,643; and, 4,051,994 the prior art is replete with myriad and diverse structural modifications which incorporate a stiffening means into an otherwise flaccid and/or flexible packaged food receptacle; whereby, the opening in the receptacle may be resealed a number of times to keep the package contents fresh.

While all of the aforementioned prior art constructions are more than adequate for the purpose of accomplishing their basic objective, these patented resealable arrangements are also uniformly deficient in the following areas: they do not prevent the packaging from tearing along the sides of the receptacle thereby spilling the package contents; and, they also fail to provide a mechanism whereby the mouth of the package may be maintained in either a fully open or a fully closed disposition.

Given the stated deficiencies in the prior art packaging constructions, it should not come as a surprise that there has been a longstanding and longfelt need among those most concerned with this area of technology for the development of an improved resealable bag closure arrangement; and, that goal is the stated objective of the present invention.

BRIEF SUMMARY OF THE INVENTION

The resealable bag closure arrangement that forms the basis of the present invention comprises in general: a receptacle unit and a closure unit wherein the closure unit is operatively connected to the receptacle unit and disposed at a spaced location relative to the conventional opening in the receptacle unit.

As mentioned earlier, this arrangement was specifically developed for conventional commercially packaged food receptacles such as potato chip bags, cookie bags and the like; wherein, the receptacle unit would comprise a thin walled flexible bag member containing foodstuffs and having a factory sealed bag mouth opening formed at the top of the bag member.

The closure unit of this invention comprises in general: a thin elongated wire member that is spaced from the mouth of the bag member and physically attached to either the exterior or interior of the walls of the bag member in a generally concentric relationship relative to the mouth of the bag member.

The particular spacing and disposition of the closure unit of this invention relative to the mouth of the receptacle unit not only insures that the top of the receptacle unit may be opened in its normal fashion without disturbing the closure unit; but, more importantly minimizes the possibility that a vertical tear in the thin side walls of the bag member would migrate downwardly beyond the location of the closure unit.

In addition, in the preferred embodiment of this invention the elongated wire member of the closure unit is arranged in a serpentine or sinusoidal fashion relative to the walls of the bag member; wherein, the vertical height of the loops of wire are of a sufficient length as to facilitate the reclosure of the mouth of the bag either by a twisting or folding manipulation of that portion of the bag member walls that contain the convoluted wire member.

BRIEF DESCRIPTION OF THE DRAWINGS

These and other objects advantages, and novel features of the invention will become apparent from the detailed description of the best mode for carrying out the preferred embodiment of the invention which follows; particularly when considered in conjunction with the accompanying drawings, wherein:

FIG. 1 is a perspective view of a commercially packaged food receptacle modified in accordance with the teachings of this invention;

FIG. 2 is a front plan view of the modified food receptacle;

FIG. 3 is an enlarged detail view of one mode of deployment of the closure unit;

FIG. 4 is an enlarged detail view of another mode of deployment of the closure unit;

FIG. 5 is an enlarged isolated top plan view of a portion of the mouth of the food receptacle; and, FIG. 6 is an enlarged cross-sectional detail view of an alternate form of the preferred embodiment.

BEST MODE FOR CARRYING OUT THE INVENTION

As can be seen by reference to the drawings and in particular to FIG. 1, the resealable bag closure apparatus that forms the basis of the present invention is designated generally by the reference numeral (10). The resealable bag closure apparatus (10) comprises in general: a receptacle unit (11) and a closure unit (12). These units will now be described in seriatim fashion.

As shown in FIGS. 1 and 2, the receptacle unit (11) comprises in general: a conventional bag member (13) having at least one envelope for foodstuffs; wherein, the foodstuffs (not shown) are inserted through the mouth portion (15) of the bag member (13); whereupon, the mouth portion (15) of the bag member (13) is subsequently sealed to maintain the freshness of the foodstuffs contained therein.

The closure unit (12 which is depicted in phantom in FIGS. 1 thru 4, comprises in general: an elongated closure member (20) which is operatively secured to the frangible walls (14) of the bag member (13) at a location that is proximate to but spaced from the mouth portion (15) of the bag member (13). In addition, the elongated closure member (20) is disposed around the periphery of the frangible walls (14) of the bag member (13); wherein, the closure unit (12) may be disposed in a surrounding relationship to the receptacle unit (11), or vice versa, depending upon the particular orientation selected by a manufacturer of the apparatus (10) of this invention.

As can be appreciated particularly by reference to FIGS. 1 and 2, the elongated closure member (20) of this invention comprises a length of flexible wire (21) which is disposed in a serpentine configuration around either the internal or external periphery of the bag member (13). In the embodiment depicted in FIGS. 1 thru 4, the flexible wire (21) is disposed around the internal periphery of the bag member (13), and as a consequence the flexible wire (21) is shown in phantom.

However, in FIG. 5 both of the preferred embodiments of this invention are depicted wherein flexible wire (21) is shown in solid lines on the internal periphery of the walls (14) of the bag member (13); whereas, the flexible wire (21) is depicted by dashed lines when disposed on the external periphery of the bag member (13).

It should also be appreciated at this juncture that when the receptacle unit (11) comprises a well recognized multi-ply bag wall construction as depicted in FIG. 6, the flexible wire (21) may be disposed intermediate the internal (14'') and external (14') walls of the bag member (13).

As depicted in FIGS. 1 and 2, the presence of the wire element (21) at a location proximate to, but spaced from the mouth (15) of the bag member (13), insures that any vertically oriented tear at the mouth (15) of the bag member (13) will only be able to migrate downwardly to the location of the juncture of the wire (21) with the frangible walls (14) of the bag member (13).

As can be appreciated by reference to FIGS. 2, 3 and 4, the effective vertical height (h) of the serpentine loops (21') of the flexible wire (21) is dimensioned such that: the wire reinforced portions of the bag member (13) may be either twisted as shown in FIG. 3, or rolled as depicted in FIG. 4 to effect the closure of the lower portion of the bag member (13).

Turning now to FIG. 5, it can also be appreciated that regardless of whether the flexible wire (21) is affixed to either the interior or exterior surface of the walls (14) of the bag member (13), the presence of the flexible wire (21) will impart a degree of rigidity to the normally flaccid walls (14) of the bag member (13); such that the mouth (15) of the bag member (13) may also be maintained in a fully open disposition to facilitate access to the contents of the bag member (13).

Having thereby described the subject matter of this invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A resealable bag closure apparatus comprising:

a bag member having at least one flexible wall which defines a receptacle having a mouth portion; and, an elongated flexible wire operatively attached to said at least one flexible wall and disposed at a location that is proximate to, but spaced from the mouth portion of said bag member; whereby said flexible wire is adapted to cooperate with the flexible wall of the bag member to form a closure below the mouth portion of the bag member; wherein, the elongated flexible wire is disposed in a serpentine configuration around the periphery of the bag member.

2. The apparatus as in claim 1 wherein the elongated flexible wire is attached to the internal surface of said at least one flexible wall.

3. The apparatus as in claim 1 wherein the elongated flexible wire is attached to the external surface of said at least one flexible wall.

* * * * *